US007131480B2

(12) United States Patent
Briscoe et al.

(10) Patent No.: US 7,131,480 B2
(45) Date of Patent: Nov. 7, 2006

(54) COLONIAL STYLE PRESSURE VENT HURRICANE SHUTTER

(76) Inventors: Thomas R. Briscoe, 2841 Shoreview Dr., Naples, FL (US) 34112; Harley E. Briscoe, 2823 Gulfview Dr., Naples, FL (US) 34112

( * ) Notice: Subject to any disclaimer, the term of this patent is extended or adjusted under 35 U.S.C. 154(b) by 0 days.

(21) Appl. No.: 11/222,114

(22) Filed: Sep. 8, 2005

(65) Prior Publication Data

US 2006/0027345 A1 Feb. 9, 2006

Related U.S. Application Data

(60) Division of application No. 10/647,673, filed on Aug. 25, 2003, now Pat. No. 6,996,934, which is a continuation-in-part of application No. 09/966,622, filed on Oct. 1, 2001, now abandoned.

(51) Int. Cl.
*E05D 15/26* (2006.01)

(52) U.S. Cl. ..... 160/117; 160/213

(58) Field of Classification Search ..... 160/117, 160/118, 113, 199, 213, 104; 49/61, 63, 49/67; 52/202, 473, 78
See application file for complete search history.

(56) References Cited

U.S. PATENT DOCUMENTS 1,939,781 A * 12/1933 Kelsey ..... 160/206
2,923,027 A * 2/1960 Bury ..... 16/248
3,020,951 A * 2/1962 Graulich ..... 160/35
3,440,786 A * 4/1969 Weaver ..... 52/780
4,431,044 A * 2/1984 Bruneau ..... 160/117
5,307,858 A * 5/1994 Turner ..... 160/213
5,737,874 A * 4/1998 Sipos et al. ..... 49/67
6,536,174 B1 * 3/2003 Foster et al. ..... 52/473
6,996,934 B1 * 2/2006 Briscoe et al. ..... 49/67

* cited by examiner

*Primary Examiner*—David Purol
(74) *Attorney, Agent, or Firm*—The Livingston Firm; Edward M. Livingston; Angela M. Miller

(57) ABSTRACT

A colonial style pressure-vent hurricane shutter having predetermined requisite strength of shutter framework (1) encompassing slatted-louver apertures (4) with slat-support guides (7) for protection against storm-borne objects, wind and rain and venting harmful buildups and bursts of pressure from vacuums created on building from hurricane forces. The shutter framework includes structural beams to which ends of slanted slats (5) are attached rigidly. Ends of slat-support guides (7) are affixed intermediate the ends of both the inward edges of the slanted slats (6) and the outward edges of the slanted slats (21). The shutter framework (1) have hold down tabs (22) to keep the shutter framework (1) from being blown open during a storm. The shutter framework (1) has ribbed hinges (25) to at least one side of a building aperture in accordance with desired shutter style and structure which include top-hinged Bahama Shutters (8) and sides-hinged Colonial Shutters (9).

7 Claims, 8 Drawing Sheets

COLONIAL STYLE PRESSURE VENT HURRICANE SHUTTER

CROSS REFERENCE TO RELATED APPLICATION

This is a division of application Ser. No. 10/647,673, filed on Aug. 25, 2003 now U.S. Pat. No. 6,996,934, which is a continuation in part of application Ser. No. 09/966,622 filed Oct. 1, 2001, now abandoned.

BACKGROUND OF THE INVENTION

This invention relates to hurricane shutters and more particularly to a hurricane shutter that protects requisitely against storm-borne objects, wind and rain while also venting buildups and bursts of pressure and vacuum that react on buildings from hurricanes and other severe storms.

Devastation from severe hurricanes has resulted in storm-area legal requirements and personal interest in adequate storm protection that also is attractive, convenient and, if possible, also low cost. Numerous storm-protective shutters have occurred as a result. None, however, vent buildups and bursts of pressure and vacuum that react on buildings from hurricanes in addition to providing requisite protection against storm-borne objects, wind and rain in a manner taught by this invention.

Examples of most-closely related known but different devices are described in the following patent documents:

| Number | Inventor | File Date | Issue Date | Classification |
|---|---|---|---|---|
| U.S. Pat. No. 6,536,174 B | Foster et al. | May 07, 2001 | Mar. 25, 2003 | 52/473 |
| U.S. Pat. No. 3,039,155 | Iacovoni | Oct. 07, 1959 | Jun. 19, 1962 | 49/67 |
| U.S. Pat. No. 5,737,874 | Sipos et al. | Dec. 15, 1994 | Apr. 14, 1998 | 49/67 |
| U.S. Pat. No. 5,907,929 | Poma et al. | Nov. 21, 1997 | Jun. 01, 1999 | 49/62x |
| U.S. Pat. No. 5,617,683 | Ney | Mar. 25, 1996 | Apr. 08, 1997 | 52/202 |
| U.S. Pat. No. 4,368,594 | Milam et al. | Feb. 12, 1981 | Jan. 18, 1983 | 49/67 |
| U.S. Pat. No. 2,013,824 | Ensminger | | September, 1935 | 160/77 |
| U.S. Pat. No. 1,646,522 | Berg | | October, 1927 | 49/356 |
| U.S. Pat. No. 2,716,785 | Schoen | Oct. 21, 1953 | Sep. 06, 1955 | 49/67 |
| U.S. Pat. No. 3,667,161 | Sassano | Oct. 16, 1970 | Jun. 06, 1972 | 49/56 |
| U.S. Pat. No. 3,691,687 | Economou | Aug. 06, 1971 | Sep. 19, 1972 | 49/74 |

The Foster et al., Iacovoni, and Sipos et al. shutters do not provide weld guides to keep shutters from turning in during hurricane forces as taught by this invention. The Poma et al. shutter requires a removable rigid support for requisite protection. Shutters described by Ney, Milan et al., Ensminger, Berg and Schoen do not have pressure venting as taught by this invention. The Sassano patent does not disclose shutters, but rather a shutter operating mechanism. The Economou shutter teaches slidable slats not requiring weld guides for support.

SUMMARY OF THE INVENTION

Objects of patentable novelty and utility taught by this invention are to provide a pressure-vent hurricane shutter which:

vents damaging buildups and bursts of pressure and vacuum that react on buildings from hurricanes;

provides legally requisite protection against storm-borne objects, wind and rain;

can be made attractive in a variety of structural styles; and can be cost-effective for the level of protection provided.

This invention accomplishes these and other objectives with a pressure-vent hurricane shutter having preferably at least legally-requisite strength of framework encompassing slatted-louver apertures for protection against storm-borne objects, wind and rain in addition to venting damaging buildups and bursts of pressure and vacuum that react on buildings from hurricanes. The framework includes structural beams to which ends of slanted slats are attached rigidly and to which inward edges of the slanted slats are attached to the back wall of a slat-support guide and the outward edges of the slanted slats are attached to the front wall of the slat-support guide. The framework is hinged with the requisite strength to at least one side of a building aperture in accordance with desired shutter style and structure which include top-hinged Bahama and sides-hinged Colonial styles.

BRIEF DESCRIPTION OF DRAWINGS

This invention is described by appended claims in relation to description of a preferred embodiment with reference to the following drawings which are explained briefly as follows:

DESCRIPTION OF PREFERRED EMBODIMENT

Figure 1:
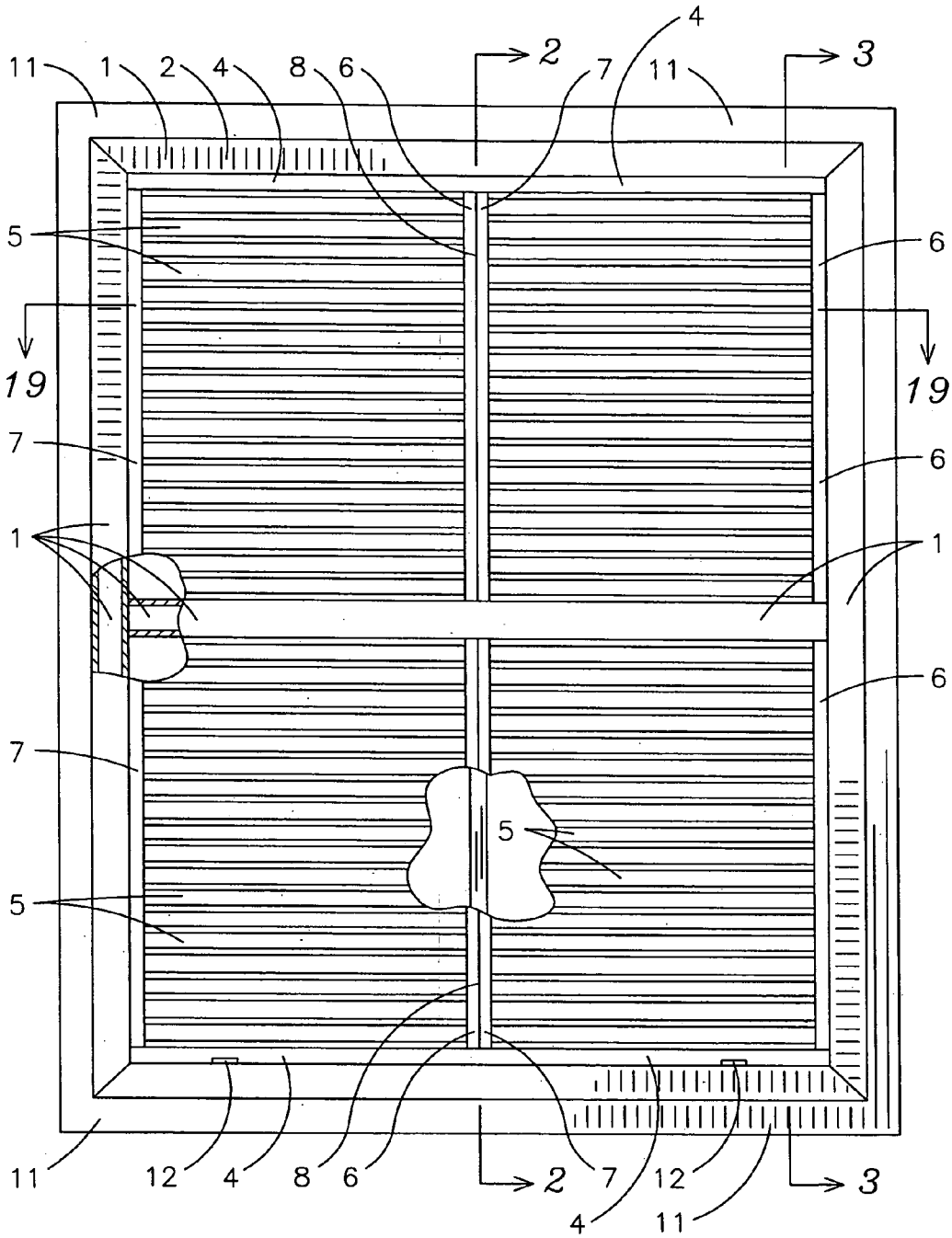
FIG. 1 is a partially cutaway front elevation view of a Bahama-Shutter embodiment.
Figure 2:
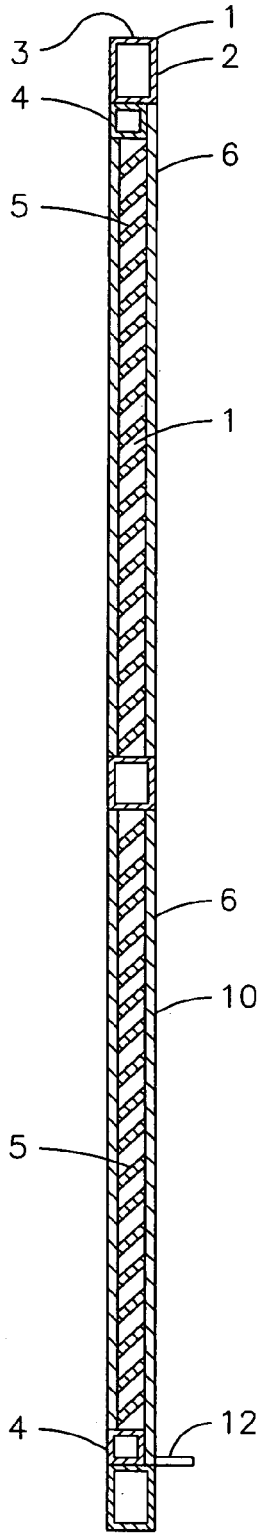
FIG. 2 is a is a section view through section line 1—1 of FIG. 1.
Figure 3:
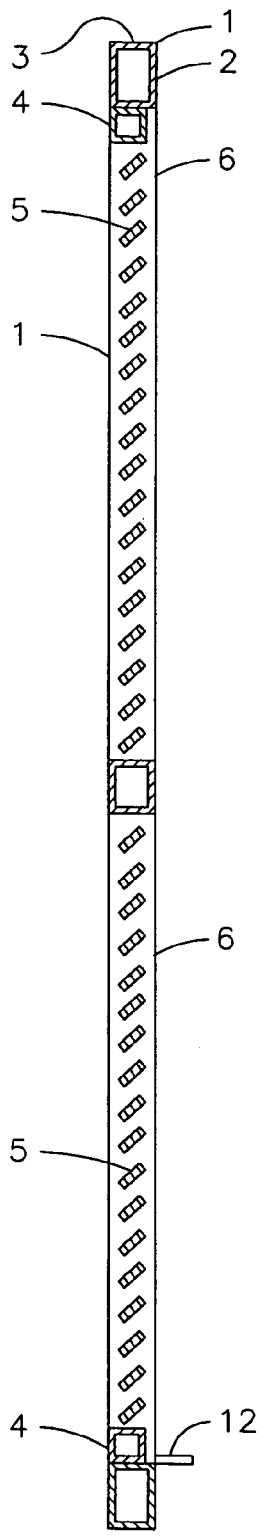
FIG. 3 is a is a section view through section line 2—2 of FIG. 1.
Figure 4:
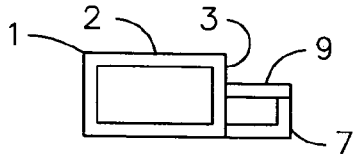
FIG. 4 is an end view of a framework member.
Figure 5:
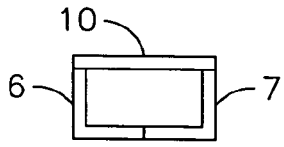
FIG. 5 is an end view of a slat-support guide.

Listed numerically below with reference to the drawings are terms used to describe features of this invention. These terms and numbers assigned to them designate the same features throughout this description.

1. shutter framework
2. face walls
3. edge walls
4. slatted-louver apertures
5. slanted slats
6. inward edges of guides
7. slat-support mullions
8. bahama shutters
9. colonial shutters
10. top hinge
11. build out frame
12. wooden structure
13. concrete build out frame
14. shutter hinge
15. colonial build out frame
16. frame hinges
17. structure wings
18. frame wings
19. shutter-hinge bolt
20. hang structure
21. outward edges of slats
22. hold down tab
23. metal plate
24. window jamb
25. rib
26. side wall of slat-support guide
27. front wall of slat-support guide
28. back wall of slat-support guide
29. slot Referring to FIGS. 1–5, a pressure-vent hurricane shutter has at least one shutter framework 1 that includes structural beams that preferably are structural metal tubes having face walls 2 that are about two inches wide and edge walls 3 that are one-and-one half inches wide. A shutter spacer 4 is located proximate to the shutter framework and is oriented horizontally. The face walls 2 and the edge walls 3 are about one-eighth inch thick and made preferably of structural aluminum alloy 6063-T52 or a substantial equivalent.

The substantial equivalent can be a ferrous alloy that is preferably stainless and rustproof with either an adequate coating or content of nickel, chrome, aluminum or other stainless constituent.

The shutter framework 1 encompasses slatted-louver apertures 4 having slanted slats 5 with slat ends affixed to the shutter framework 1. The slanted slats 5 have inward edges 6 and outward edges 21 that are oriented horizontally and attached to slat-support guides 7. The slat-support guides 7 are oriented vertically with ends attached to horizontal portions of the shutter framework 1. Both the inward edges of the slats 6 and the outward edges of the slats 21 are orthogonal to the slat-support guides 7. The inward edges of the slats 6 are attached to the back wall of the slat-support guide 28. The outward edges of the slats 21 are attached to the front wall of the slat-support guide 27. The slats 5 feed through the slots 29 located on the side walls of the slat-support guide 26.

The shutter framework 1 also encompasses hold down tabs 22 located on the horizontal portions of the shutter framework 1. The hold down tabs 22 on Bahama Shutters 8 are located on the bottom horizontal shutter framework 1. The hold down tabs 23 on Colonial Shutters 9 are located on the top and bottom horizontal shutter framework 1. A quarter-inch screw is inserted through the hold down tab 22 into a metal plate 23 correspondingly mounted onto the window jamb 26. The hold down tabs 22 hold the shutter framework 1 to the window jamb 26 to keep the shutter framework 1 from blowing open during a storm. Shutter hinges 14 with ribs 26 are located on the shutter framework 1 to keep the shutter framework 1 from hitting the window jamb 26.

The slatted-louver apertures 4 includes an entire slatted enclosure of a plurality of apertures between the slanted slats 5 and the shutter framework 1. The plurality of apertures individually are slanted with preferably about one-half inch of distance of slant orthogonally between surfaces of the slanted slats 5. The slanted slats 5 are preferably flat aluminum bar stock about one-quarter inch thick and one inch wide. Between bottoms and tops of adjacent slanted slats 5, there are horizontal apertures about one-eighth inch high and having a length that is a length of the slanted slats 5, less a width of the slat-support guides 7. The slat-support guides 7 have two side walls 26, a front wall 27, and a back wall 28. The slat-support guides 7 are attached to the inward edges of the slats 6 as well as the outward edges of slats 21 to keep the slanted slats 5 from turning in and maintaining proper separation and angle when under pressure from high winds. The slat-support guides 7 have the appearance of mullions so as to give a more aesthetic appearance.

A pressure-vent object of this hurricane shutter is to allow predeterminedly slight passage of wind and rain horizontally straight through slatted-louver apertures of the shutter framework 1 and slightly more directional-change passage while also providing structural strength to prevent breakage by storm-borne objects, wind and rain of hurricanes. Allowing directional-change passage of hurricane-force wind and rain while stopping large storm-borne objects and directional-change diversion of small objects like sand and small debris eliminates directly damaging aspects of hurricanes more effectively and much more cost effectively than by totally stopping the hurricane-force wind and rain. Completely blocking strong hurricane forces requires much stronger building structure and subjects the building structure to hurricane bursts of pressure and vacuum that react on buildings.

Figure 8:
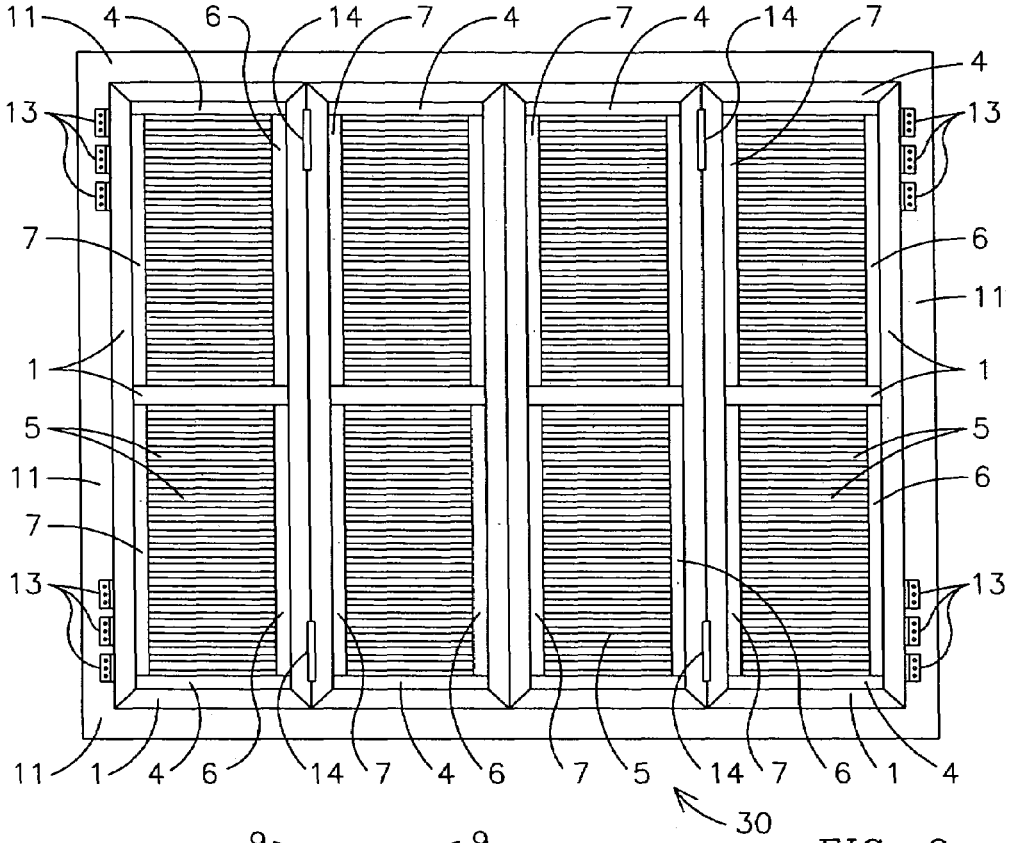
FIG. 8 is a partially cutaway side elevation view of a Bahama-Shutter embodiment mounted on a generally concrete frame and being in an open mode.
Figure 9:
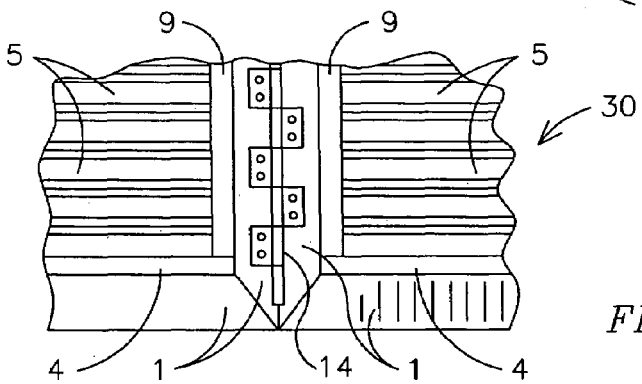
FIG. 9 is the FIG. 8 illustration in a closed mode.
Figure 10:
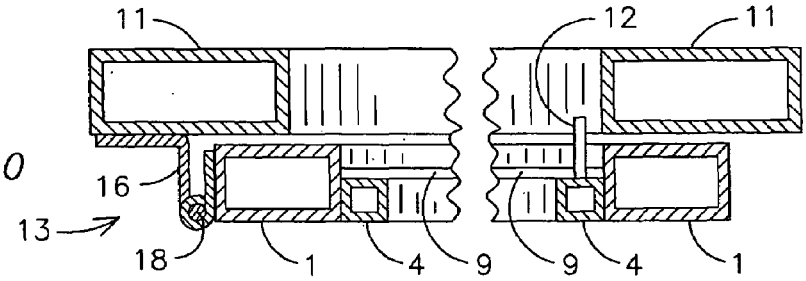
FIG. 10 is a front elevation view of a colonial-shutter embodiment having triple-louver sections for doors and large windows in a closed mode.
Figure 11:
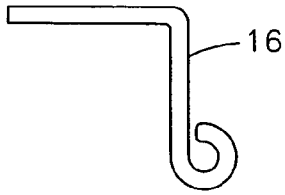
FIG. 11 is a front elevation view of a colonial-shutter embodiment having double-louver sections for average-sized doors and windows in a closed mode.
Figure 12:
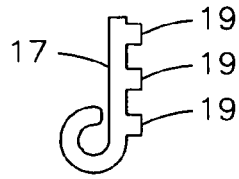
FIG. 12 is a fragmentary view of a colonial-shutter hinge shown hinging two portions of the Colonial Shutter together.
Figure 13:
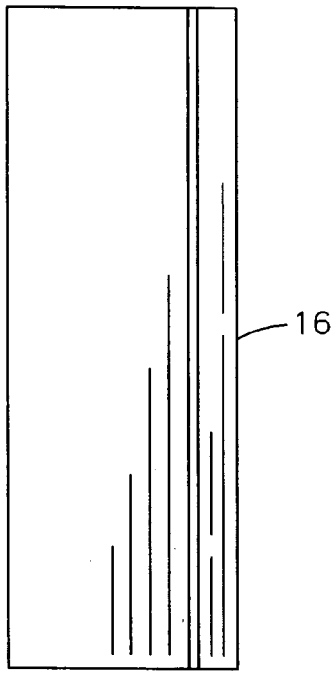
FIG. 13 is a fragmentary end view of a preferred shutter hinge that can be used either horizontally for hang-hinging Bahama Shutters or vertically for swing-hinging Colonial Shutters.
Figure 14:
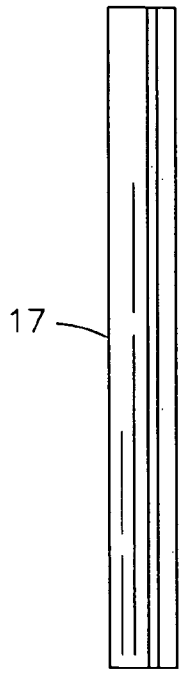
FIG. 14 is an end view of a structure wing of the preferred shutter hinge that is shown in the FIG. 13 illustration.
Figure 17:
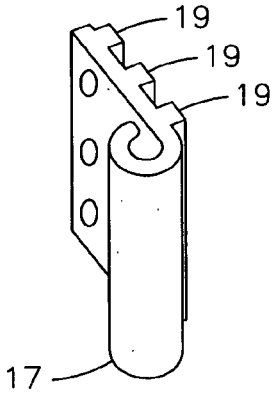
FIG. 17 is a top view of the frame wing of the preferred shutter hinge that is shown in the FIG. 13 illustration.

Included on fronts of slatted-louver apertures 4 of Bahama Shutters 8 shown in FIGS. 1–9 and Colonial Shutters 9 shown in FIGS. 10–12 are portions of the slatted-louver apertures 4 that are straight through horizontally between bottoms and tops of vertically adjacent slanted slats 5. Also shown are portions of slatted-louver apertures 4 that are slanted between the slanted slats 5 that are juxtaposed vertically.

Figure 6:
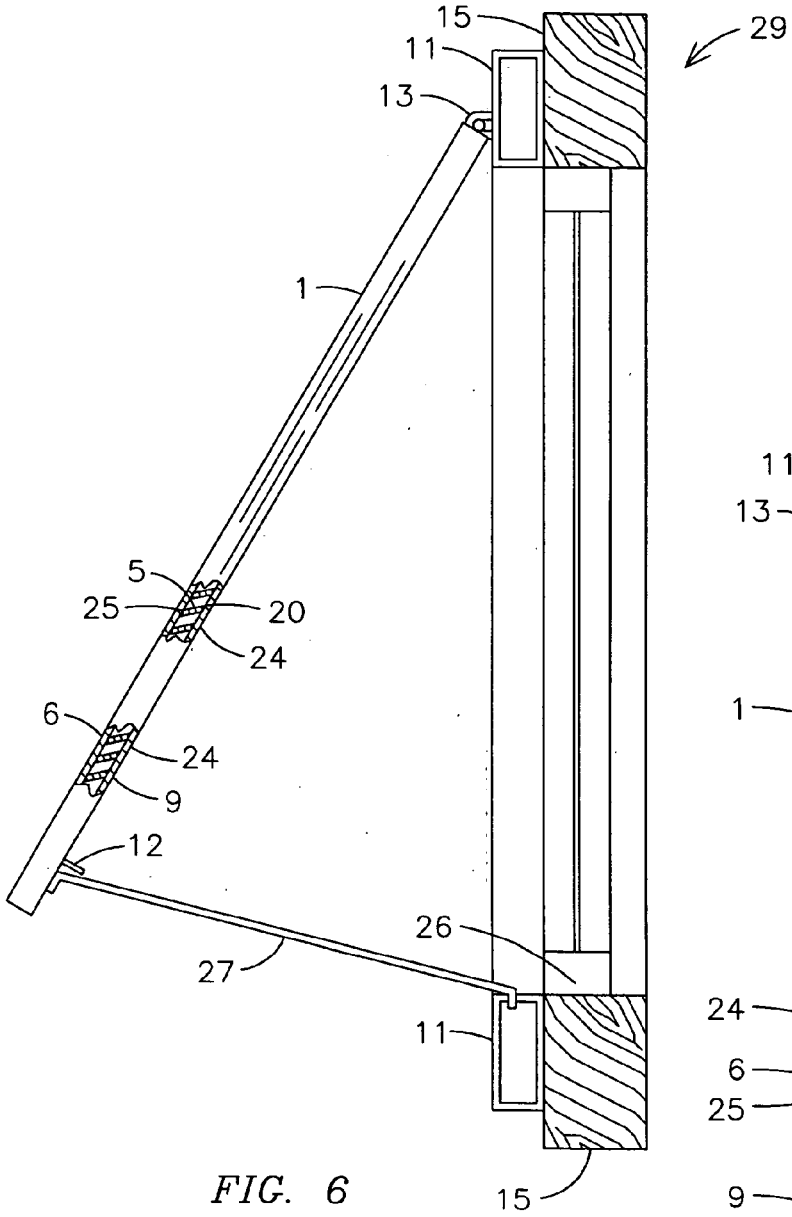
FIG. 6 is a partially cutaway side elevation view of a Bahama-Shutter embodiment mounted on a generally wooden frame and being in an open mode.
Figure 7:
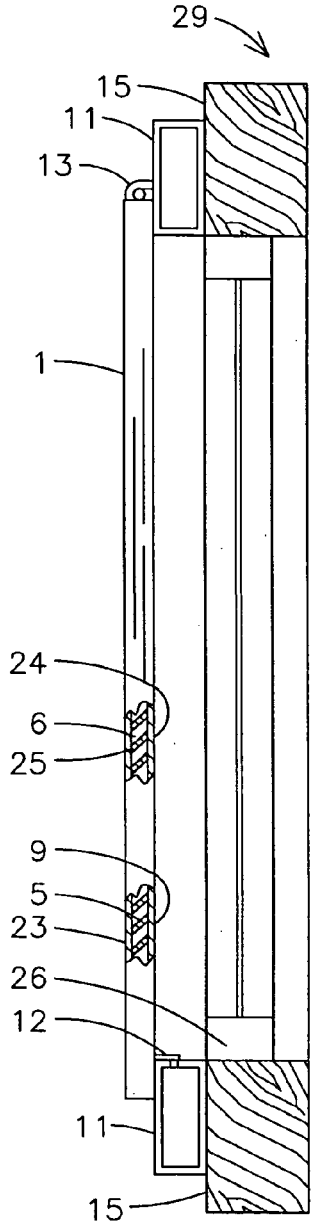
FIG. 7 is the FIG. 6 illustration in a closed mode.

Referring to FIGS. 6–9, the shutter framework 1 is sized, shaped and designed predeterminedly for a Bahama Shutter 8 having a top hinge 10 with which it is hinged to the structural member which includes a build out frame 11 on a building having wooden, structure 12 shown in FIGS. 6–7 and which includes a concrete build out frame 13 on a building having concrete structure shown in FIGS. 8–9. The top hinge 10 is representative of a selection of Bahama Shutter hinges having appropriate strength and operativeness for legal and other predetermined requisites for hinging hurricane shutters to building apertures.

Referring to FIGS. 10–11, the shutter framework 1 is sized, shaped and designed predeterminedly for a Colonial Shutter 9 having a shutter hinge which includes shutter hinges 14 with which it is hinged to the structural member. The structural member includes a Colonial build out frame 15 on the building. The Colonial Shutter 9 includes frame hinges 16 with which pluralities of the shutter frameworks 1 are hinged together for side-folding.

The Colonial build out frame 15 is shown in two size and structural options that include two inside horizontal portions of the shutter framework 1 shown in FIG. 10 and one inside horizontal portion of the shutter framework 1 shown in FIG. 11. These options are for different sizes and shapes of building apertures in buildings. The building apertures in the buildings are not shown separately from structural members which include the build out frame 15 in FIGS. 10–11, the wooden structure 12 in FIGS. 6–7 and the concrete build out frame 13 in FIGS. 8–9.

Referring to FIG. 12, the frame hinges 16 can include a selection of aluminum hinges and other frame-fold hinges which can be positioned in accordance with folding characteristics of Colonial Shutters. The frame hinges 16 in this illustration are shown on back sides of the shutter framework 1 with the slanted slats 5 and the slat-support guides 7 being seen in front of the slanted slats 5.

Figure 18:
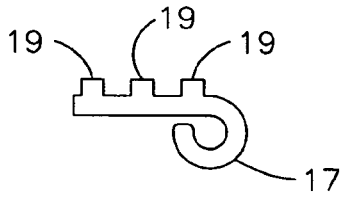
FIG. 18 is a fragmentary side view of the preferred shutter hinge in which the structure wing is shown attached to a metallic or other rigid form as seen from a left side of the FIG. 13 illustration and the frame wing is shown from a bottom of the FIG. 13 illustration.
Figure 15:
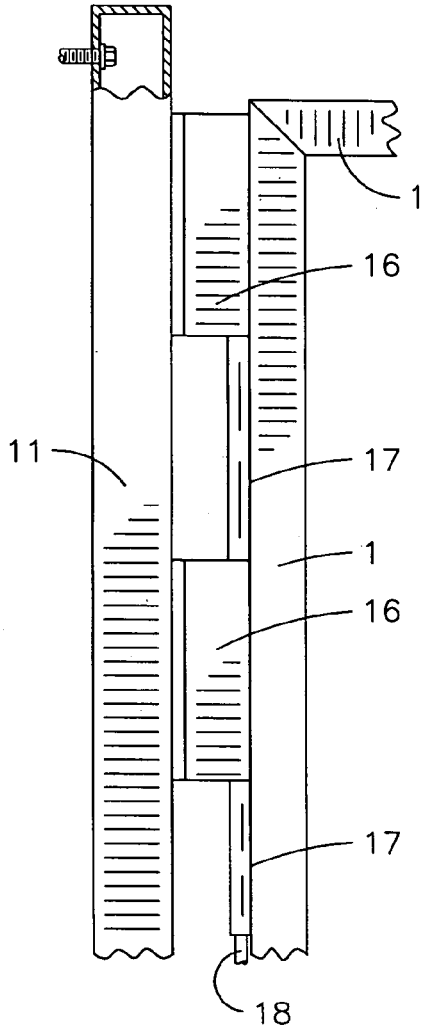
FIG. 15 is an end view of a frame wing of the preferred shutter hinge that is shown in the FIG. 13 illustration.
Figure 16:
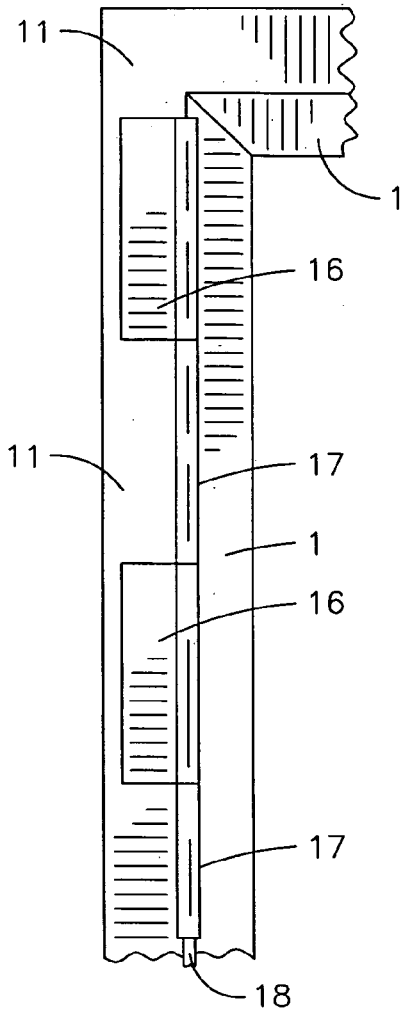
FIG. 16 is a top view of the structure wing of the preferred shutter hinge that is shown in the FIG. 13 illustration.
Figure 19:
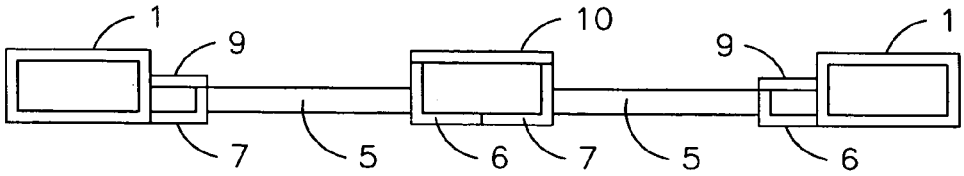
FIG. 19 is a fragmentary side view of the preferred shutter hinge in which the structure wing is shown attached to a wooden or other less rigid form as seen from a top side of the FIG. 13 illustration and the frame wing is shown from the bottom of the FIG. 13 illustration.

Referring to FIGS. 13–19, the shutter hinge 14 is a preferred hinge that can be used either horizontally for hang-hinging Bahama Shutters 8 or vertically for swing-hinging Colonial Shutters 9. The shutter hinges 14 have ribs 25 to keep the shutter framework 1 from hitting the window jamb 24, thus preventing paint from rubbing off of shutter framework 1. For the Colonial Shutters 9, the shutter hinge 14 can be swing-hinged and include a fold-back mode with structure wings 17 attached to the Colonial build out frame 15 and with frame wings 18 attached to the shutter framework 1 and joined by a shutter-hinge bolt 19 as depicted in FIG. 19.

As shown in FIGS. 6–9 and 18 for the Bahama Shutters 8, the shutter hinge 14 with ribs 25 can be hang-hinged and include a hanging mode with structure wings 17 attached to a hang structure 20 which can include the build out frame 11, the wooden structure 12 and the concrete build out frame 13 selectively. The frame wings 18 are attached to the shutter framework 1 and joined by a shutter-hinge bolt 19 as depicted in FIG. 18. The hold down tabs 22 are located on the horizontal portion of the shutter framework 1. A one-quarter inch screw is can be inserted through the hold down tab 22 into a metal plate 23 correspondingly mounted onto the window jamb 26. The hold down tabs 22 hold the shutter framework 1 to the window jamb 24, helping to keep the shutter framework 1 from blowing open during a storm.

Figure 20:
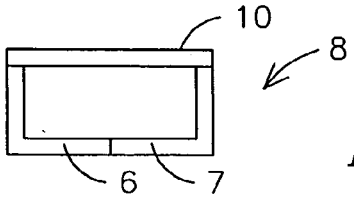
FIG. 20 is a perspective view of a shutter hinge with ribs.
Figure 21:
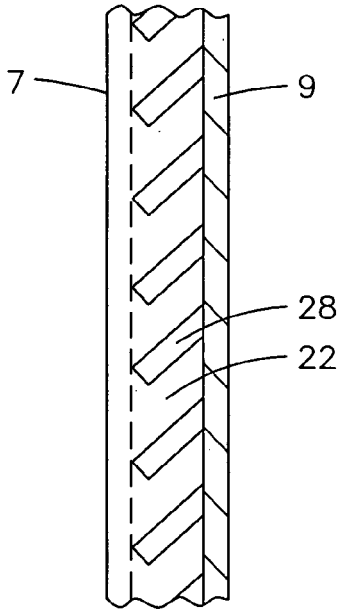
FIG. 21 is a side view of a shutter hinge with ribs.

Referring to FIGS. 20 and 21, the shutter hinge 14 is shown with ribs 26.

Figure 22:
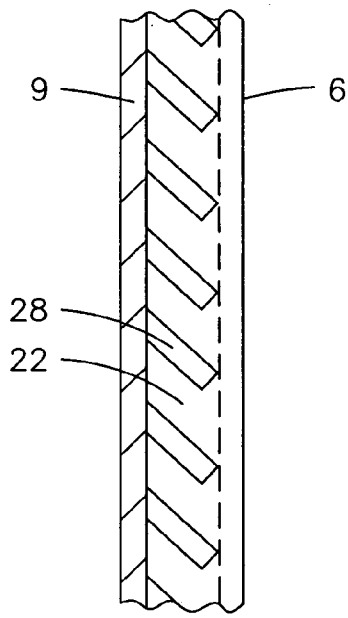
FIG. 22 is a section view through section line 22—22 of FIG. 1.

Referring to FIG. 22, a cross-section of slanted slat 5 is shown affixed to slat-support guides 7. The slat-support guides 7, in turn, are affixed to the shutter framework 1.

Figure 23:
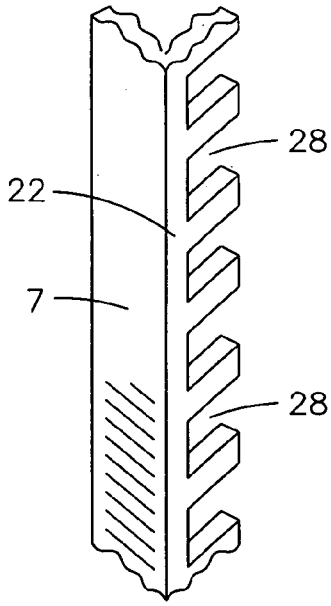
FIG. 23 is an end view of a slat-support guide.

Referring to FIG. 23, the end view of a slat-support guide 7 is shown. The slat-support guide consists of two side walls 26, a front wall 27, and a back wall 28 affixed together at joining ends.

Figure 24:
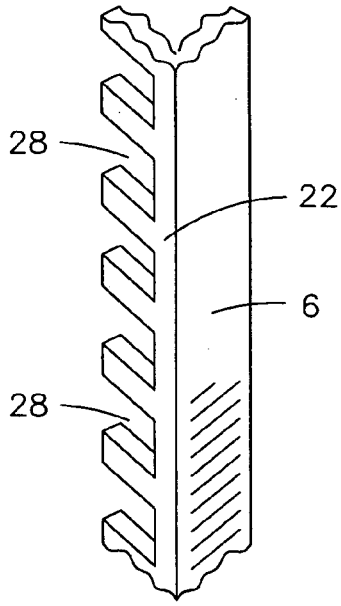
FIG. 24 is a side view of a slat-support guide.

Referring to FIG. 24, a side view of a slat support guide 7 is shown without the slanted slats 5. The side walls 26 have slots 29 where the slanted slats 5 feed through.

Figure 25:
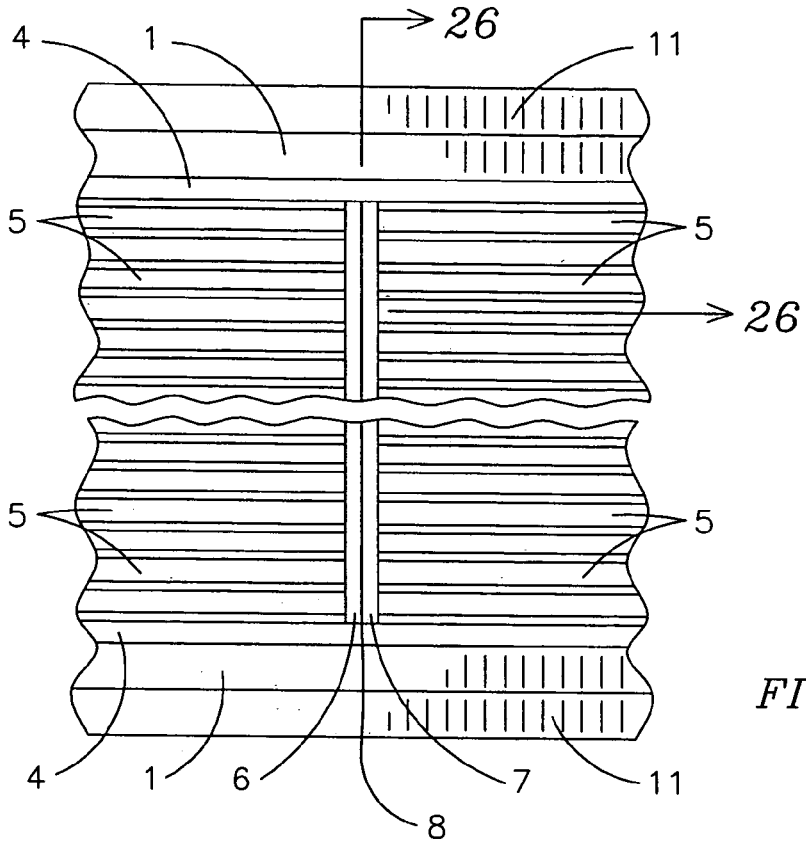
FIG. 25 is a perspective view of a slat-support guide.

Referring to FIG. 25, a perspective view of a slat-support guide 7 is shown by itself.

Figure 26:
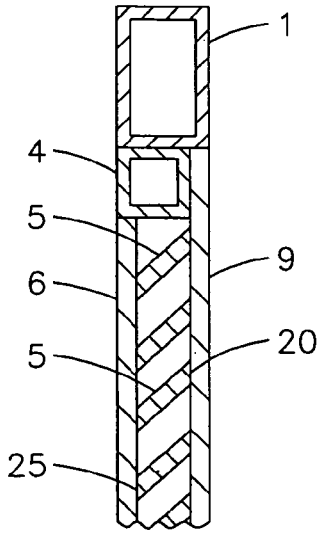
FIG. 26 is a front view of a slat-support guide.

Referring to FIG. 26, a front view of a slat-support guide 7 is shown.

Figure 27:
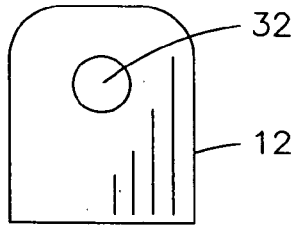
FIG. 27 is a section view through section line 27—27 of FIG. 26.

Referring to FIG. 27, a cross-section of a slat-support guide is shown.

The structure wings 17 and the frame wings 18 of the shutter hinges 14 are made preferably of structural aluminum alloy 6063-T5, 6061-T6 or a substantial equivalent. As for other metallic components, the substantial equivalent can be a ferrous alloy that is preferably stainless and rustproof with either an adequate coating or having suitably alloyed content of nickel, chrome, aluminum and/or other stainless constituent.

A new and useful pressure-vent hurricane shutter having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A colonial style pressure-vent hurricane shutter comprising:

at least one shutter framework encompassing slatted-louver apertures;

said shutter framework including structural beams to which ends of slanted slats for the slatted-louver apertures are affixed;

slat-support guides oriented vertically and having ends;

said shutter framework including a shutter spacer to which said ends of said slat-support guides for the slatted-louver apertures are affixed;

slat-support cover affixed to one slat-support guide;

mullion slat-support cover affixed to at least two adjacent slat-support guides;

said structural beams on said shutter framework affixed to the outside edge of said slat-support guides;

the slanted slats having inward edges that are oriented orthogonally to the mullion slat-support covers;

the slanted slats having outward edges that are oriented orthogonally to the slat-support guides;

the inward edges intermediate the ends of the slanted slats being attached to the mullion slat-support covers;

the outward edges intermediate the ends of the slanted slats being attached to the slat-support guides;

at least one shutter hinge proximate at least one edge of the shutter framework;

the shutter framework being hinged to at least one structural member of a building proximate a building aperture;

the shutter framework is a Colonial Shutter having side-hinges with which it is hinged to sides of the structural member of the building proximate the building aperture;

the shutter framework, the slanted slats, the slat-support guides and the hinge having a structural composite that has at least predetermined requisite strength for shutter-related protection of the building against storm-borne objects, wind and rain;

the slatted-louver apertures having predetermined venting of storm buildups and bursts of pressure and vacuum that react on buildings; and the shutter hinge is ribbed.

2. A colonial style pressure-vent hurricane shutter comprising:

at least one shutter framework encompassing slatted-louver apertures;

the shutter framework is a Colonial Shutter having a ribbed side-hinge attachment to sides of at least one structural member of a building proximate a building aperture;

the shutter framework including structural beams to which ends of slanted slats for the slatted-louver apertures are affixed and to which ends of slat-support guides are attached orthogonally to the slanted slats intermediate the ends of inward edges of the slanted slats;

the shutter framework, the slats, the slat-support guides and the hinge having a structural composite that has at least predetermined strength for shutter-related protection of the building against storm-borne objects, wind and rain;

the slatted-louver apertures having predetermined venting of storm buildups and bursts of pressure and vacuum that react on buildings;

the structural beams included in the shutter framework are structural metal tubes having a cross section that is rectangular; and a metal of which the structural metal tubes are made has predetermined material strength, rigidity, thickness and structure for the shutter framework to have the structural composite with at least the predetermined strength for shutter-related protection of the building against storm-borne objects, wind and rain.

3. The colonial style pressure-vent hurricane shutter of claim 2 wherein:

the structural beams included in the shutter framework are structural aluminum tubes having a cross section that is rectangular with face walls being about two inches wide and orthogonal edge walls being about one and one-half inches wide;

the face walls and the edge walls being about one-eighth of an inch thick;

the metal of the structural aluminum tubes being aluminum alloy 6063-T52 or at least a substantial equivalent thereof;

the structural beams of the shutter framework are affixed together at joining edges;

the slanted slats include structural flat-bar metal have a cross section that is rectangular;

a metal of which the slanted slats are made has predetermined material strength, rigidity, thickness and structure for the slanted slats to have the structural composite with at least the predetermined strength for slatted-louver protection of the building against storm-borne objects, wind and rain;

the slanted slats are structural aluminum flat bar having a cross section that is rectangular with face walls being about one inch wide and edge walls being about one-quarter of an inch wide;

the slanted slats being about one-quarter of an inch thick;

the metal of the slanted slats being aluminum alloy 6063-T52 or at least a substantial equivalent thereof;

the ends of the slanted slats are affixed to the shutter framework;

the slat-support guides are structural aluminum alloy 6063-T52 or at least a substantial equivalent thereof having rectangular cross section with a width of about one inch and a thickness of about one-eighth inch;

the slat-support guides have ends which are affixed to the shutter framework; and the inward edges of the slanted slats are affixed to the slat-support guides.

4. The colonial style pressure-vent hurricane shutter of claim 2 wherein:

the face walls of the slanted slats are spaced apart about one-half inch orthogonally; and the slanted slats are juxtaposed vertically with dihedral angles of the face walls and dihedral angles of the edge walls being horizontal.

5. The colonial style pressure-vent hurricane shutter of claim 2 wherein:

hold down tabs are affixed to top and bottom portions of horizontal shutter framework;

said hold down tabs have a hole in which a screw of a predetermined size can be inserted; and said hold down tabs are made of a metal of predetermined material strength, rigidity, thickness and structure for the shutter framework to have the structural composite with at least the requisite strength for shutter-related protection of the building against storm-borne objects, wind and rain.

6. The colonial style pressure-vent hurricane shutter of claim 5 wherein:

the shutter framework have metal plates with a hole corresponding with the location of the hold down tabs.

7. The colonial style pressure-vent hurricane shutter of claim 2 wherein:

said slat-support guides have a front wall, two side walls, and a back wall joined together along longitudinal edges of the walls;

the slat-support guides are structural aluminum alloy 6063-T52 or at least a substantial equivalent thereof;

said slat-support guide front and back walls having rectangular cross sections with a width of about one inch and a thickness of about one-eighth inch;

said slat-support guide side walls having rectangular cross sections with a width of about one-half inch and a thickness of about one-eighth inch;

said slat-support guide side walls having slots distributed evenly to correspond with shape, size, and direction of slanted slats;

said front wall of slat-support guide affixed to outward edges of slanted slats;

said back wall of slat-support guide affixed to inward edges of slanted slats;

said slat-support guides have ends which are affixed to the shutter framework; and the slat-support guides have the appearance of mullions.

* * * * *